US006345759B1

(12) United States Patent
Boyd

(10) Patent No.: US 6,345,759 B1
(45) Date of Patent: Feb. 12, 2002

(54) GABLE TOP CARTON WITH ENLARGED POUR SPOUT OPENING

(75) Inventor: Craig Boyd, Arlington Heights, IL (US)

(73) Assignee: Tetra Laval Holdings & Finance, SA, Pulluy (CH)

( * ) Notice: Subject to any disclaimer, the term of this patent is extended or adjusted under 35 U.S.C. 154(b) by 0 days.

(21) Appl. No.: 09/776,445

(22) Filed: Feb. 2, 2001

(51) Int. Cl.[7] ..... B65D 5/74
(52) U.S. Cl. ..... 229/125.42; 229/137
(58) Field of Search ..... 229/125.42, 137, 229/213, 214, 249

(56) References Cited

U.S. PATENT DOCUMENTS

| | | | | |
|---|---|---|---|---|
| 2,321,139 A | | 6/1943 | Gruger | |
| 3,125,276 A | * | 3/1964 | Zinn | 229/214 |
| 3,185,375 A | | 5/1965 | Thomas | |
| 3,232,516 A | | 2/1966 | Arslanian | |
| 3,327,920 A | | 6/1967 | Hynes et al. | |
| 3,349,988 A | | 10/1967 | Horning | |
| 3,554,430 A | * | 1/1971 | MacEwen | 229/214 |
| 3,825,168 A | * | 7/1974 | MacEwen | 229/214 |
| 4,184,624 A | | 1/1980 | MaGill | |
| 4,327,861 A | | 5/1982 | Thompson | |
| 4,433,784 A | | 2/1984 | Kjelgaard | |
| 4,657,175 A | | 4/1987 | Martensson | |
| 4,884,695 A | | 12/1989 | Kjelgaard | |
| 5,118,036 A | * | 6/1992 | Manderson | 229/137 |
| 5,337,538 A | * | 8/1994 | Ljungstrom | 229/137 |
| 5,685,479 A | * | 11/1997 | Weber-Caspers | 229/125.42 |
| 5,988,494 A | * | 11/1999 | Fontaine | 229/249 |
| 6,142,364 A | * | 11/2000 | Laker et al. | 229/213 |

FOREIGN PATENT DOCUMENTS

DE 26 35 722 A1 2/1978

* cited by examiner

*Primary Examiner*—Gary E. Elkins
(74) *Attorney, Agent, or Firm*—Welsh & Katz, Ltd.

(57) ABSTRACT

A non-square cross-section gable top carton has an enlarged pour spout opening. The gable top is openable at one side and is formed from opposing outer gable walls, opposing inner gable walls and a spout wall. The outer gable walls have a plurality of pairs of angled creases formed therein. A first pair of creases corresponds to angled creases separating the inner gable walls from the spout wall. A second pair of angled creases are adjacent respective first creases and extend from about first terminal locations with the first creases to third terminal locations proximate the fin and rearward of the first crease second terminal locations. The third terminal locations are at a rearward distance from a front edge of the carton a distance greater than one-half of the width of the carton. A blank for forming the carton is also disclosed.

14 Claims, 2 Drawing Sheets

GABLE TOP CARTON WITH ENLARGED POUR SPOUT OPENING

BACKGROUND OF THE INVENTION

The present invention relates to a gable top carton having an enlarged pour spout opening. More particularly, the present invention relates to a non-square cross-section gable top carton having an enlarged pour spout opening defined by multiple creases in the gable.

The traditional gable top carton is in wide spread use for liquid food packaging and various particulate and solid foods packaging. For example, the conventional gable top carton has become fairly widely used for packaging soups and the like that contain particulate in liquid and/or powdered combinations.

In that these packages are readily manufactured from relatively low cost materials and can be processed, e.g., filled, with high speed filling lines, it would be advantageous to package other types of goods in such packages. One problem is that the size of the pour spout opening is limited to that that is formed when the gable panels are unfolded. In those instances where the containers are relatively small, for example, (70 mm×70 mm, and 95 mm×95 mm) the opening of the spout is limited to less than one half of the dimension of the container. That is, for a 70 mm×70 mm container, the opening of the spout is limited to 35 mm×35 mm. This limitation is true (a spout opening size limited to one half of each dimension of the container) regardless of the size or configuration of the container.

This size limitation limits the type of product that can be stored and dispensed from the container. For example, many dry cereals, such as corn flakes vary in size as does the product make-up of some snack foods, such as snack mix. As a result, products such as these may not lend themselves well for storage and dispensing from traditional gable top containers.

Accordingly, there exists a need for a gable top carton or container that has an enlarged pour spout opening. Desirably, such a container is configured so that the pour spout opening is sufficiently large for readily dispensing various types and sizes of products. Most desirably, such a container includes a pour spout opening that has an opening size that is greater than one half of the dimensions of the overall carton configuration.

BRIEF SUMMARY OF THE INVENTION

A non-square, gable top carton has an enlarged pour spout opening. The carton is formed from four upstanding side walls. A first pair of opposing side walls have a first width and an opposing pair of sides walls have a second width less than the first width. The carton includes a sealed bottom wall contiguous with the upstanding sides walls.

A gable top is openable at one side thereof. The gable top is formed from opposing outer gable walls, opposing inner gable walls and a spout wall. The opposing outer gable walls are contiguous with the wider side walls. The opposing inner gable walls and spout wall are contiguous with one of the narrower side walls. The gable top terminates at an upstanding fin.

The outer gable walls are separated from their respective inner gable walls by longitudinal creases formed therebetween. The inner gable walls are separated from the spout wall by a pair of angled creases formed therebetween. The inner gable walls are folded within the upstanding fin.

The outer gable walls have a plurality of pairs of angled creases formed therein for forming the opening. Preferably, the outer gable walls have two pairs of angled creases. A first pair of angled creases corresponds to the angled creases separating the inner gable walls from the spout wall. Each of the first pair of angled creases extends from a first terminal location about a juncture of the outer gable wall, the inner gable wall and their respective upstanding side walls to a second terminal location proximate the fin.

Each of the second pair of angled creases is adjacent a respective one of the first pair of creases. Each of the second pair of angled creases extends from about the first terminal location to a third terminal location proximate the fin and spaced from and rearwardly of the second terminal location. The third terminal location is at a rearward distance from an edge of the fin a distance greater than one-half of the narrower carton width.

The carton is opened at a portion of the gable top folding the outer gable walls along the first pair of angled creases to expose the inner gable walls and spout wall. The spout wall is urged away from the inner gable walls, and is opened further by folding the outer gable walls along the second pair of creases to a point on the fin rearward of an intersection of the inner gable walls being folded within the upstanding fin.

The third terminal location can be spaced rearwardly of the second terminal location a distance from an edge of the fin that is at least about one-half of the upstanding narrower carton width. Preferably, the third terminal location is spaced a distance from the edge of the fin a distance greater than one-half of the narrower carton width.

To facilitate readily opening the carton at the fin, the fin is sealed with abhering means to the third terminal location.

A blank for the enlarged pour spout opening carton includes first and third wall panels having a first width and second and fourth wall panels having a second width less than the first width. A fifth panel is adjacent the fourth wall panel for securing to the first wall panel. A plurality of bottom wall panels are contiguous with the first, second, third, fourth and fifth wall panels.

A plurality of gable panels form a gable top and a plurality of fin panels are contiguous with the gable panels. The fin panels are configured for sealing the carton. The gable panels include outer gable panels adjacent the first and third wall panels, inner gable panels adjacent the second and fourth wall panels, and a spout panel adjacent the second wall panel.

The fin panels extend from and are contiguous with the inner and outer gable panels. The outer gable panels are separated from their respective inner gable panels by longitudinal creases formed therebetween. The inner gable panels are separated from the spout panel by a pair of angled creases formed therebetween. The outer gable panels have a plurality of pairs of angled creases formed therein.

A first pair of angled creases correspond to the angled creases separating the inner gable panels from the spout panel. Each of the first pair of angled creases extends from a first terminal location about a juncture of the outer gable panel, the inner gable panel and their respective upstanding side wall panels to a second terminal location at or proximate the fin.

A second pair of angled creases are each adjacent a respective one of the first pair of angled creases. Each second crease extends from about the first terminal location to a third terminal location spaced from the second terminal location. The third terminal location is at a distance from a juncture with the second panel at least one-half of the second and fourth panel second width. The third terminal location is at or proximate the fin. A vertical crease can be formed in the fin at the third terminal location.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
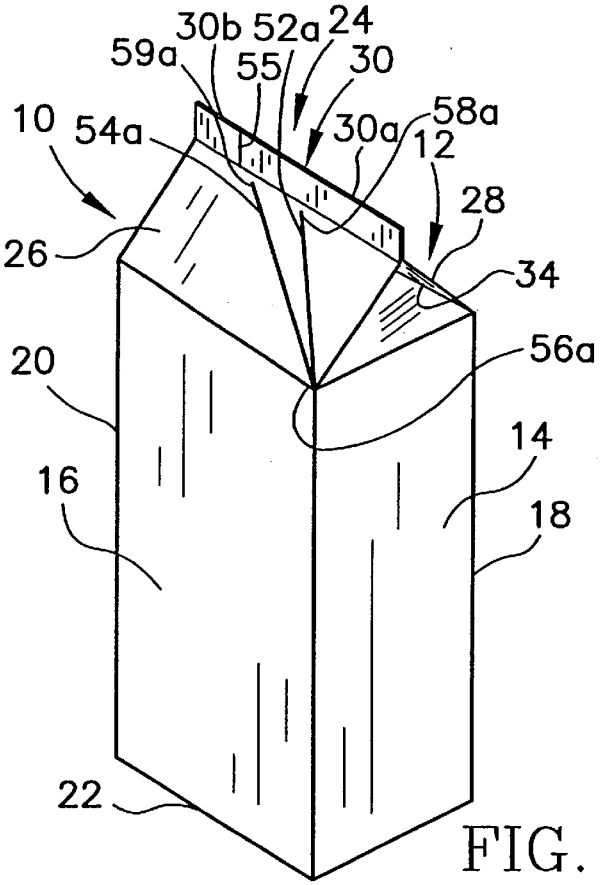
FIG. 1 is a perspective view of a sealed gable top carton having an enlarged pour spout opening embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

Figure 2:
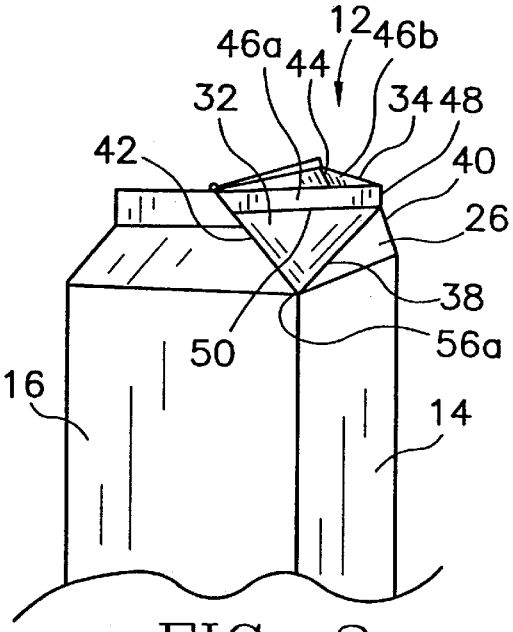
FIG. 2 is a perspective view of the top of the carton of FIG.1 with the pour spout open.

Referring now to the figures and in particular FIG. 1, there is shown a gable top carton 10 having an enlarged pour spout opening 12 embodying the principles of the present invention. The carton 10 includes four upstanding side walls (a front wall 14, opposing side walls 16, 18 and a rear wall 20) and a sealed bottom wall 22. The carton 10 further includes a traditionally appearing gable top configuration, as indicated generally at 24. The gable top 24 is formed from outer gable walls 26, 28 that terminate at a sealed fin 30. As seen in FIG. 2, inner gable walls 32, 34 are sealed under the outer gable walls 26, 28 and, in part, within the fin 30 as is known in the art. The carton 10 is opened in a manner consistent with traditional gable top cartons, by separating one side 30*a* of the fin 30 at the outer and inner gable walls 26, 28 and 32, 34 and pulling a spout wall 36 from the other gable walls 26, 28 and 32, 34.

As is seen in FIG. 2, and as will be recognized by those skilled in the art, the spout wall 36 is separated or distinguished from the inner gable walls by first and second angled crease lines 38, 40. The inner gable walls 32, 34 are separated from the outer gable walls 26, 28 by first and second longitudinal crease lines 42, 44. An upper fin wall 46, separated into first and second portions 46*a*, 46*b* (by a small longitudinal crease 48) extends upwardly from the top of the inner gable walls 32, 34, and is separated from the inner gable walls by a transverse crease 50. The top of the spout wall 36 terminates at about the longitudinal crease 48.

As will be recognized by those skilled in the art, in traditional gable top cartons in which the carton is opened to form a spout, the outer gable walls each include an angled crease that generally corresponds to the angled crease formed between the inner wall and the spout wall. In this manner, when the fin portion is separated from itself to expose the inner gable walls and spout wall, the separation and folding of the inner and outer gable panels occurs along these angled crease lines. These first crease lines, and more particularly the location at which these crease lines intersect the fin walls, define the size of the spout opening.

Also in traditional gable top cartons in which the cartons have a square cross-section, the longitudinal crease line defined by the upper fin wall when the carton is fully erected and sealed lies at about a center line of the carton. This is true for both the front portion of the gable (where the front portion is defined as that part of the carton that opens) as well as the rear portion of the gable (which is that part of the carton that remains fully sealed). As a result, because of the location at which these two longitudinal crease lines essentially meet in the constructed carton, another limitation on enlarging the size of the opening is created.

The present invention overcomes these limitations in non-square cross-section cartons by providing two sets of angled creases (i.e., first creases 52*a,b* and second creases 54*a,b*) in the outer gable walls 26, 28 in the front portion of the carton 10. Each of the second creases 54*a,b* is formed from about a common location, as indicated at 56*a,b* with the bottom of the first outer gable wall creases 52*a,b* and extends upwardly into or proximate the fin 30. The termini, as indicated at 59*a,b* of the second creases 54*a,b* is rearward of the termini, as indicated at 58*a,b*, of the first outer gable wall creases 52*a,b*. Thus, in a carton 10 embodying the present invention, two sets of mirror image creases 52*a,b* and 54*a,b* are formed in the front portion of the outer gable walls 26, 28. A vertical crease 55 can be formed in the fin 30 at the termini 59*a,b*.

Figure 3:
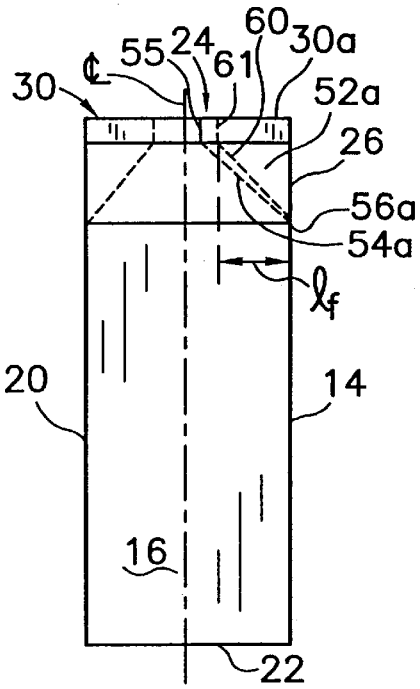
FIG. 3 is a side view of the sealed carton of FIG. 1.
Figure 4:
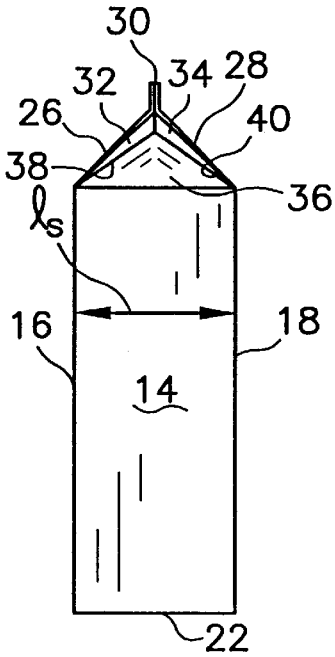
FIG. 4 is a front view of the carton.
Figure 5:
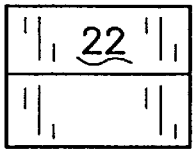
FIG. 5 is a top view of the carton.

As will be recognized by those skilled in the art, in non-square cross-section cartons, the upper fin wall creases 48, for both the front and rear portions of the carton 10, do not meet or touch one another at a center line of the carton 10, as shown by the dashed lines generally at 60 in FIG. 3. Rather, the point, as indicated at 61, at which the folded upper fin walls 46*a,b* reside within the fin 30 is defined by the length $l_f$ of the upper fin wall pairs 46*a,b*. This in turn is defined as ½ of the length $l_s$ of the side of the carton, by the geometry of the carton 10. In cartons having a larger side-to-front or side-to-rear ratio, the ratio of the length of the side of the carton to the length of the upper fin wall ($l_s/l_f$)will be greater. As such, the second outer gable wall creases 54*a,b* can extend farther along the depth of the carton 10, thus defining a larger carton opening 12.

As will be appreciated from a study of the drawings, the present carton 10 provides a two-step opening. The first opening is defined by the traditional or standard (i.e., first) crease lines 52*a,b* in the outer gable walls 26, 28 that correspond to the creases (angled creases 38, 40) between the spout wall 36 and the inner gable walls 32, 34. The second step of the opening 12 is a further separation of the side 30*a* of the top fin 30 up to the second outer gable wall crease lines 54*a,b*. Separating the fin portion 30*a* up to this second set of crease 54*a,b* provides the additional open area (e.g., enlarged area) through which product can be dispensed or poured from the package 10.

To facilitate readily separating the fin panels 30*a* from one another, that is, opening the package 10, various methods are known. In an anticipated carton, an abhesive A (best seen in FIG. 6) is applied to the upper fin walls 46*a,b* and those portions of the fin walls up to the juncture, as indicated at 62, of the second creases 54*a,b* with the fin 30. This permits readily opening the package 10 up to the second creases 54*a,b* for establishing the enlarged opening 12. The vertical crease 55 can be used to set a location up to which the spout 12 is opened. Various abhesives will be recognized by those skilled in the art, as will other methods for providing readily separable, yet sealed panels.

Figure 6:
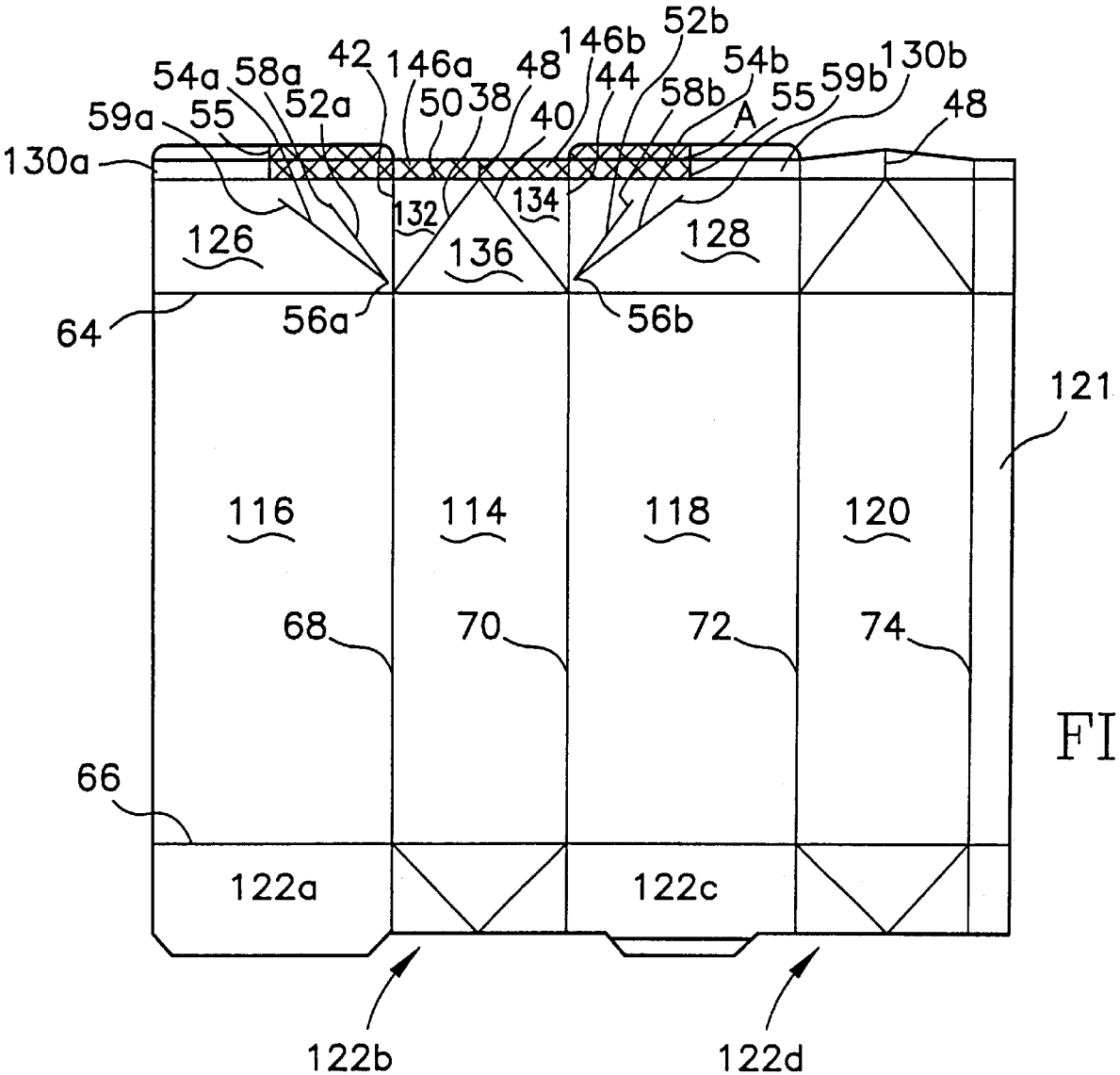
FIG. 6 is a plan view of a blank for the carton embodying the principles of the present invention.

A blank 110 for use in constructing a carton 10 having an enlarged spout opening 12 is illustrated in FIG. 6. For purposes of the following description, blank panels will be identified by three-digit (100 series) numbers that correspond to the two-digit numbers identifying the various walls and other pertinent structure of the carton 10 in the erected or constructed form. The creases, folds and the like are shown having the same identifying numbers in the figure of the blank (FIG. 6), as in the figures of the carton (FIGS. 1–5).

The blank 110 includes wall panels (referred to herein as a first panel 116, a second panel 114, a third panel 118 and a fourth panel 120) that correspond to a side wall 16, the front wall 14, the other side wall 18, and rear wall 20, and bottom panels 122*a–d* that correspond to the sealed bottom wall 22. The blank 110 further includes gable panels 126, 128 that correspond to the outer gable walls 26, 28, inner gable wall panels 132, 134 that correspond to inner gable walls 32, 34, and a spout panel 136 that corresponds to spout wall 36. The wall panels 114–120 are separated from the gable panels 126, 128, 132, 134 and 136 by an upper transverse score or crease line 64. Likewise, the bottom wall panels 122*a–d* are separated from the wall panels 114–120 by a lower transverse score or crease line 66. The wall panels 114–120 are separated from adjacent panels by longitudinal crease lines 68–74.

The blank 110 includes a fifth panel 121 for sealing to the first panel 116 to create the sealed tubular configuration for use in conventional form, fill and seal packaging machines.

As discussed above, the longitudinal creases 42, 44 separate the outer gable panels 126, 128 from the inner gable panels 132, 134, and angled creases 38, 40 separate the spout panel 136 from the inner gable panels 132, 134.

Upper fin wall panels 146*a,b* extend from the inner gable panels 132, 134 and are separated from one another by longitudinal crease 48 and are separated from the outer gable panels 126, 128 by longitudinal creases 42, 44.

Also as discussed above, two sets of creases 52*a,b* and 54*a,b* are formed in the outer gable panels 126, 128. The first set of creases 52*a,b* corresponds to the angled creases 38, 40 that separate the inner gable panels 132, 134 from the spout panel 136. These are the creases that are provided in traditional gable top cartons. The second set of angled creases 54*a,b*, which are formed in the outer gable wall panels 126, 128, extend from a common location 56*a,b* with the terminal portion of creases 52*a,b*, and extend upward to or proximate the fin panel crease 50. These second creases 54*a,b* are formed in the outer gable walls 126, 128 rearwardly of the first outer gable wall creases 52*a,b*. Thus, in a blank 110 embodying the present invention, there are two sets of mirror image creases 52*a,b* and 54*a,b* formed in the outer gable panels 126, 128. A vertical crease 55 (shown at two places) can be formed in fin panels 130*a,b*, adjacent the ends of the creases 54*a,b*.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A carton having a non-square cross-section, the carton having an enlarged pour spout opening, the carton comprising:

upstanding side walls, a first pair of opposing side walls having a first width and a second pair of opposing sides walls having a second width less than the first width;

a sealed bottom wall contiguous with the upstanding sides walls; and a gable top openable at one side thereof, the gable top formed from opposing outer gable walls, opposing inner gable walls and a spout wall, the opposing outer gable walls being contiguous with the side walls having the first width, opposing inner gable walls and spout wall being contiguous with one of the upstanding side walls having the second width, the gable top terminating at an upstanding fin, the outer gable walls being separated from their respective inner gable walls by longitudinal creases formed therebetween, the inner gable walls being separated from the spout wall by a pair of angled creases formed therebetween, the inner gable walls being folded within the upstanding fin, the outer gable walls having a plurality of pairs of angled creases formed therein;

a first pair of angled creases corresponding to the angled creases separating the inner gable walls from the spout wall, each of the first pair of angled creases extending from a first terminal location about a juncture of the outer gable wall, the inner gable wall and their respective upstanding side walls to a second terminal location proximate the fin; and a second pair of angled creases, each of the second pair of angled creases being adjacent a respective one of the first pair of creases, each of the second pair of angled creases extending from about the first terminal location to a third terminal location proximate the fin and spaced from and rearwardly of the second terminal location, the third terminal location being at a rearward distance from an edge of the fin a distance greater than one-half of the upstanding side wall second width, wherein the carton is opened at a portion of the gable top folding the outer gable walls along the first pair of angled creases to expose the inner gable walls and spout wall and urging the spout wall away from the inner gable walls, and is opened further by folding the outer gable walls along the second pair of creases to a point on the fin rearward of an intersection of the inner gable walls being folded within the upstanding fin.

2. The carton in accordance with claim 1 wherein the third terminal location is spaced rearwardly of the second terminal location at a rearward distance from an edge of the fin a distance at least about one-half of the upstanding wall first width.

3. The carton in accordance with claim 2 wherein the third terminal location is spaced rearwardly of the second terminal location at a rearward distance from an edge of the fin a distance one-half of the upstanding wall first width.

4. The carton in accordance with claim 2 wherein the third terminal location is spaced rearwardly of the second terminal location at a rearward distance from an edge of the fin a distance greater than one-half of the upstanding wall first width.

5. The carton in accordance with claim 1 wherein the upstanding fin is sealed with abhering means to the third terminal location to permit readily opening the enlarged pour spout.

6. The carton in accordance with claim 1 including a crease formed in the upstanding fin at about the third terminal location.

7. The carton in accordance with claim 1 wherein each third terminal location lies at a juncture of the upstanding fin and each respective second angled crease.

8. A blank for a carton, comprising:

first and third wall panels having a first width;

second and fourth wall panels having a second width less than the first width;

a fifth panel adjacent the fourth wall panel for securing to the first wall panel;

a plurality of bottom wall panels contiguous with the first, second, third, fourth and fifth wall panels;

a plurality of gable panels for forming a gable top and a plurality of fin panels contiguous with the gable panels, the fin panels configured for sealing the carton, the gable panels including outer gable panels adjacent the first and third wall panels, inner gable panels adjacent the second and fourth wall panels, and a spout panel adjacent the second wall panel;

a plurality of fin panels extending from and contiguous with the inner and outer gable panels, the outer gable panels being separated from their respective inner gable panels by longitudinal creases formed therebetween, the inner gable panels being separated from the spout panel by a pair of angled creases formed therebetween, the outer gable panels having a plurality of pairs of angled creases formed therein, wherein a first pair of angled creases corresponds to the angled creases separating the inner gable panels from the spout panel, each of the first pair of angled creases extending from a first terminal location about a juncture of the outer gable panel, the inner gable panel and their respective upstanding side wall panels to a second terminal location about the fin, and a second pair of angled creases, each of the second pair of angled creases being adjacent a respective one of the first pair of angled creases and extending from about the first terminal location to a third terminal location spaced from the second terminal location proximate one of the fin panels, the third terminal location being at a distance from a juncture with the second panel at least one-half of the second and fourth panel second width.

9. The blank for a carton in accordance with claim 8 wherein the third terminal location distance from the juncture with the second panel is one-half of the second width.

10. The blank for a carton in accordance with claim 8 wherein the third terminal location distance from the juncture with the second panel is greater than one-half of the second width.

11. The blank for a carton in accordance with claim 8 wherein a ratio of the first width to the second width is at least 1.25.

12. The blank for a carton in accordance with claim 8 wherein at least a portion of the fin panels includes abhering means.

13. The blank for a carton in accordance with claim 8 including a crease formed in a corresponding upstanding fin panel at about the third terminal location.

14. The blank for a carton in accordance with claim 8 wherein each third terminal location lies at a juncture of the fin panel and each respective second angled crease.

* * * * *